US012545476B2

(12) United States Patent
Niggemyer

(10) Patent No.: US 12,545,476 B2
(45) Date of Patent: Feb. 10, 2026

(54) NOZZLE AND CAP ASSEMBLY FOR DISPENSING POUCH

(71) Applicant: Fred William Niggemyer, Fremont, OH (US)

(72) Inventor: Fred William Niggemyer, Fremont, OH (US)

(73) Assignee: DECKO PRODUCTS, LLC, Sandusky, OH (US)

( * ) Notice: Subject to any disclaimer, the term of this patent is extended or adjusted under 35 U.S.C. 154(b) by 142 days.

(21) Appl. No.: 18/431,174

(22) Filed: Feb. 2, 2024

(65) Prior Publication Data

US 2024/0262572 A1 Aug. 8, 2024

Related U.S. Application Data

(60) Provisional application No. 63/482,894, filed on Feb. 2, 2023.

(51) Int. Cl.

| | |
|---|---|
| ***B65D 35/38*** | (2006.01) |
| ***B65D 41/04*** | (2006.01) |
| ***B65D 41/62*** | (2006.01) |
| ***B65D 75/58*** | (2006.01) |

(52) U.S. Cl.

CPC ..... *B65D 35/38* (2013.01); *B65D 41/0435* (2013.01); *B65D 41/62* (2013.01); *B65D 75/5883* (2013.01)

(58) Field of Classification Search

CPC .... B65D 35/38; B65D 41/0435; B65D 41/62; B65D 75/5883

See application file for complete search history.

(56) References Cited

U.S. PATENT DOCUMENTS

| | | | | |
|---|---|---|---|---|
| 560,719 | A * | 5/1896 | Name | B29C 48/03 425/191 |
| 2,801,016 | A * | 7/1957 | Satz | B65D 41/18 215/321 |
| 3,012,687 | A * | 12/1961 | Dallay | B65D 41/12 215/346 |
| 4,116,352 | A * | 9/1978 | Davis | B65D 51/145 220/240 |
| 6,270,277 | B1 * | 8/2001 | Ogino | A46B 11/0079 401/268 |
| 6,981,614 | B2 | 1/2006 | Niggemyer | |
| 7,337,923 | B2 | 3/2008 | Niggemyer et al. | |
| 9,579,685 | B2 * | 2/2017 | Starr | B05C 17/00506 |
| 9,617,054 | B2 * | 4/2017 | Niggemyer | B65D 75/5883 |
| 9,694,945 | B2 * | 7/2017 | Ciecorka | B65D 35/38 |
| 2006/0006194 | A1 * | 1/2006 | Niggemyer | B65D 75/5883 222/107 |

(Continued)

*Primary Examiner* — Ishal Pancholi

(74) *Attorney, Agent, or Firm* — Shumaker, Loop & Kendrick, LLP; James D. Miller

(57) ABSTRACT

A variable tip nozzle and cap assembly for a dispensing pouch is disclosed. The nozzle and cap assembly includes a hollow nozzle, an adapter, a hollow tip, and a cap. A seal may be disposed between the hollow nozzle and the adapter to militate against an undesired flow of material from the dispensing pouch. The material may be a confectionary for decorating cakes and cookies, for example. The adapter includes threaded portions of different diameters, which receive the hollow tip and/or the cap. The hollow tip may be configured for application of the material in a specific design.

19 Claims, 7 Drawing Sheets

(56) References Cited

U.S. PATENT DOCUMENTS

2012/0255972 A1* 10/2012 Schneider ..... B65D 1/323
222/570
2019/0023469 A1* 1/2019 Bugenske ..... B65D 41/0471

* cited by examiner

NOZZLE AND CAP ASSEMBLY FOR DISPENSING POUCH

CROSS-REFERENCE TO RELATED APPLICATIONS

This patent application claims priority to U.S. Provisional Patent Application Ser. No. 63/482,894, filed on Feb. 2, 2023, the entire disclosure of which is hereby incorporated herein by reference.

FIELD

The present disclosure relates to a nozzle and cap assembly and more particularly to a variable tip nozzle and cap assembly for a pouch for dispensing a confectionery used in the decoration of cakes and cookies, for example.

BACKGROUND

The application of a flowable confectionery to the top and sides of an iced cake or other pastry is well known in the art. Typically, the confectionery is sufficiently viscous to maintain a shape and is resistant to excessive flow or slumping after being extruded or dispensed from an associated bag or dispensing pouch. Some types of icing may tend to surface harden by reason of water evaporation after being dispensed from the pouch and, accordingly, it is desirable that the pouch and the dispensing system be substantially leak-proof to prevent evaporation of water and the resultant hardening of the contents prior to application. Typically, flexible and collapsible dispensing pouches of the type utilized for decorating cakes and cookies employ a dispensing nozzle, through which a flowable confection such as cake icing may be extruded. An example of a dispensing system is shown and described in U.S. Pat. Nos. 6,981,614 and 7,337,923, the entire contents of each of which are hereby incorporated herein by reference.

Prior art dispensing nozzles for a dispensing pouch are adapted to receive a decorating tip either alone or with a cooperating collar or compression ring. The collar threadingly engages a threaded portion of the dispensing nozzle to hold the decorating tip in place. The flowable confection is caused to be extruded through the decorating tip by collapsing the dispensing pouch by the application of pressure thereto. The shape of the free end of the decorating tip determines the final shape of the extruded confection.

In order to create extruded designs of a different type or size, use of a different decorating tip is required. Often, this requires that a different pouch and nozzle/tip assembly be used thereby exposing the confection stored in the dispensing pouch to air, resulting in drying and surface hardening.

It would be desirable to produce a nozzle and cap assembly for a dispensing pouch which accepts decorating tips of different sizes and shapes to maximize decorating efficiency.

SUMMARY

In concordance and agreement with the present disclosure, a nozzle and cap assembly for a dispensing pouch which accepts decorating tips of different sizes and shapes to maximize decorating efficiency and minimize wasted confection, has surprisingly been designed.

In one embodiment, an assembly for a dispensing pouch, comprises: an adapter having a first end, a second end, and an opening formed therethrough extending from the first end to the second end thereof, wherein the opening of the adapter has a first cross-sectional shape, and wherein the adapter is configured to releaseably engage a tip having a first end, a second end, and an opening formed therein, and wherein the opening of the tip has a second cross-sectional shape.

In another embodiment, a nozzle and cap assembly for a container, comprises: a hollow nozzle having a first end and a second end, the first end configured to be disposed in a container; an adapter configured to be releasably engaged with the second end of the hollow nozzle; a hollow tip configured to be releaseably engaged with the adapter; and a cap configured to be releaseably engaged with the adapter.

In yet another embodiment, a nozzle and cap assembly for a container comprises: a hollow nozzle having a first end and a second end, the first end configured to be joined with a container, the second end having a first threaded portion formed thereon; a threaded adapter configured to be received on the first threaded portion, the threaded adapter having a central aperture formed therein, a second threaded portion, and a third threaded portion; a hollow tip configured to be received on the third threaded portion; and a cap configured to be received on the second threaded portion.

As aspects of some embodiments, the adapter is in threaded engagement with the hollow nozzle.

As aspects of some embodiments, the adapter is in threaded engagement with the hollow tip.

As aspects of some embodiments, the adapter is in threaded engagement with the cap when the assembly is in a storable state.

As aspects of some embodiments, the second end of the hollow nozzle includes a threaded portion.

As aspects of some embodiments, the second end of the hollow nozzle extends outwardly from the container.

As aspects of some embodiments, the assembly further comprises a sealing element configured to militate against a flow of material from the container.

As aspects of some embodiments, the sealing element is reusable.

As aspects of some embodiments, the sealing element is disposed between the hollow nozzle and the adapter.

As aspects of some embodiments, the adapter is entirely external to the container.

As aspects of some embodiments, the adapter includes a plurality of threaded portions.

As aspects of some embodiments, an outer diameter of one of the threaded portions is larger than an outer diameter of another one of the threaded portions.

As aspects of some embodiments, an opening formed in the adapter has a first cross-sectional shape.

As aspects of some embodiments, an opening formed in the tip has a second cross-sectional shape.

As aspects of some embodiments, the first cross-sectional shape is different from the second cross-sectional shape.

As aspects of some embodiments, the opening formed in the adapter has a star-shaped cross-section.

As aspects of some embodiments, the opening formed in the tip has a circular cross-sectional shape.

BRIEF DESCRIPTION OF THE DRAWINGS

The above, as well as other objects, features, and advantages of the present disclosure will be understood from the detailed description of the preferred embodiments of the present disclosure with reference to the accompanying drawings, in which.

DETAILED DESCRIPTION

Figure 1:
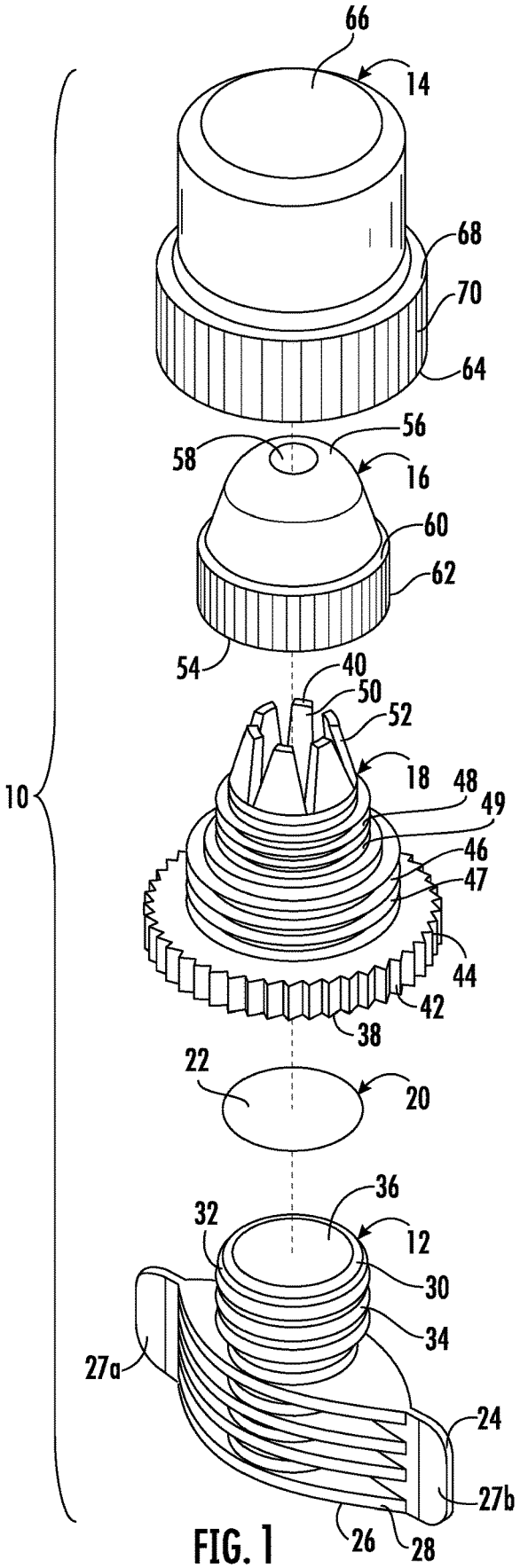
FIG. 1 is an exploded perspective view of a nozzle and cap assembly for a dispensing pouch according to an embodiment of the disclosure.

The following description of technology is merely exemplary in nature of the subject matter, manufacture and use of one or more embodiments, and is not intended to limit the scope, application, or uses of any specific embodiment claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 7:
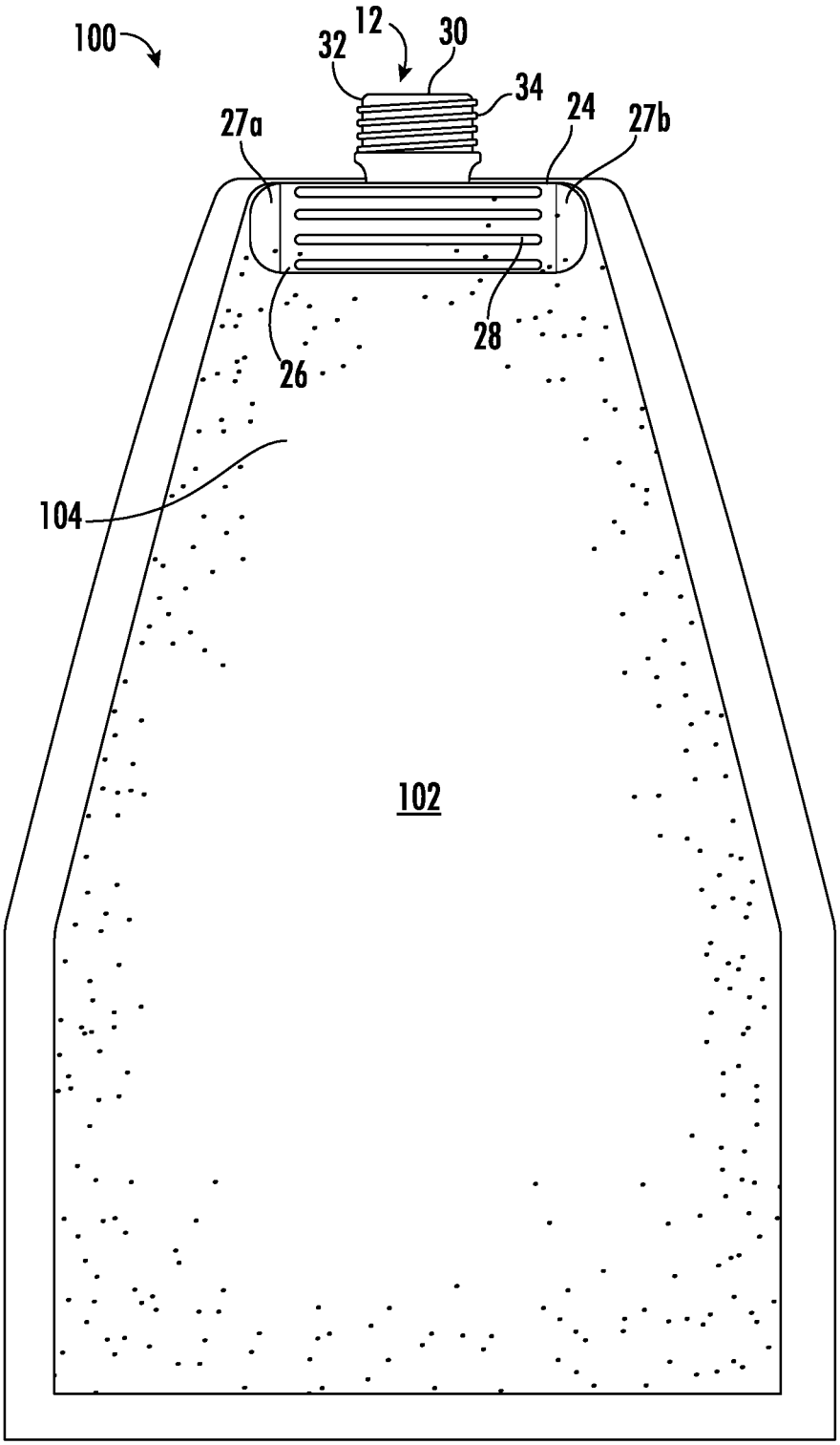
FIG. 7 is a fragmentary elevational view of a dispensing pouch joined with the collar and hollow nozzle portion of FIGS. 2A-2C.

FIGS. 1 and 6A-6E show a nozzle and cap assembly 10 according to an embodiment of the disclosure is shown. The nozzle and cap assembly 10 may be employed for use with a container or flexible dispensing pouch 100, as shown in FIG. 7. The container 100 may include an internal cavity 102 for receiving a material 104 (e.g., a confectionary, a pre-made confectionary, a fluid-like material for decorating confections, etc.) therein. It is understood that the nozzle and cap assembly 10 may be used in various other applications as desired.

The nozzle and cap assembly 10 includes a hollow nozzle 12, a cap 14, a hollow tip 16, and an adapter 18. A sealing element 20 may be disposed between the hollow nozzle 12 and the adapter 18. The sealing element 20 may be configured to militate against a flow of the material 104 from the internal cavity 102 of the container 100. In some embodiments, the sealing element 20 may be a single-use sealing element, wherein once broken the sealing element 20 may no longer be used. For example, the sealing element 20 may be a thin layer of material, foil, or film made from a metal, a plastic, or a combination thereof or a sealing element commonly referred to as a "peel seal". In other embodiments, the sealing element 20 may be reusable and/or replaceable. As a non-limiting example, the sealing element 20 may be generally disk-shaped having substantially planar opposing surfaces 22 to permit the sealing element 20 to seat between the hollow nozzle 12 and the adapter 18. It is understood, however, that the sealing element 20 may have any suitable shape, size, and configuration and made from any material(s) as desired.

Figure 2A:
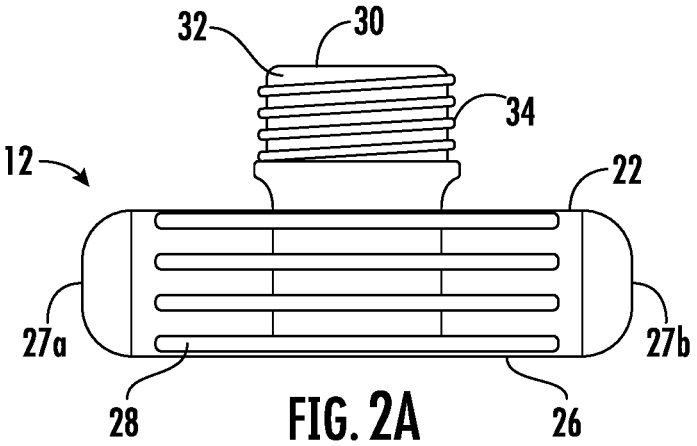
FIG. 2A is a front elevational view of a collar and hollow nozzle portion of the nozzle and cap assembly of FIG. 1.
Figure 2B:
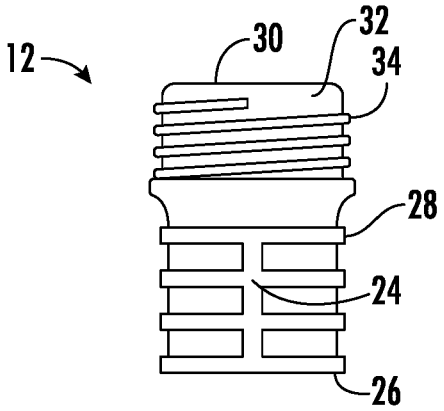
FIG. 2B is a right side elevational view of the collar and hollow nozzle portion of FIG. 2A.
Figure 2C:
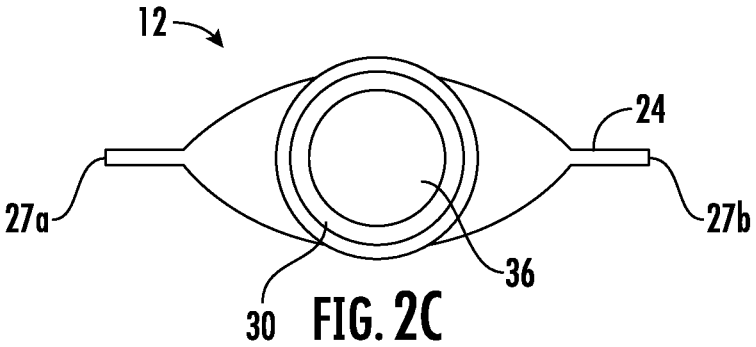
FIG. 2C is a top plan view of the collar and hollow nozzle portion of FIGS. 2A and 2B.

FIGS. 2A-2C illustrate an exemplary embodiment of the nozzle 12. The nozzle 12 includes a radially outwardly extending collar 24 formed at a first end 26 thereof. It is understood that the collar 24 may have any shape, size, and configuration to cooperate with an upper portion of the container 100. In some embodiments, the collar 24 may have a generally oblong shape and include opposing ear portions 27*a*, 27*b*. A plurality of spaced apart ribs 28 may be formed on the collar 24. The first end 26 of the collar 24 may be configured to be disposed in the internal cavity 102 of the container 100, as shown in FIG. 7. A second end 30 of the nozzle 12 extends outwardly from the container 100 and includes a threaded portion 32. As depicted, the threaded portion 32 has a plurality of external threads 34 formed thereon. The threaded portion 32 may have a first outer diameter. An opening 36 may be formed through the nozzle 12 to provide communication with the internal cavity 102 of the container 100.

Figure 3A:
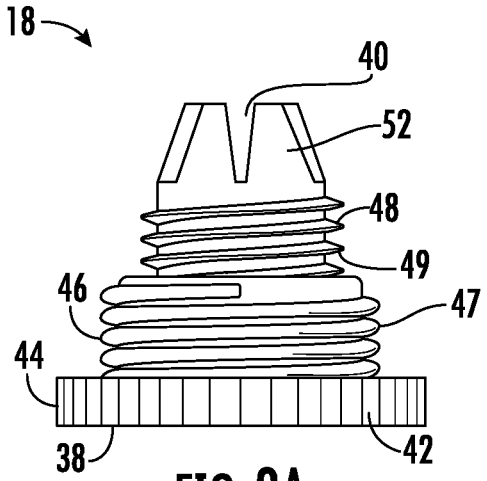
FIG. 3A is a front elevational view of a threaded adapter portion of the nozzle and cap assembly of FIG. 1.
Figure 3B:
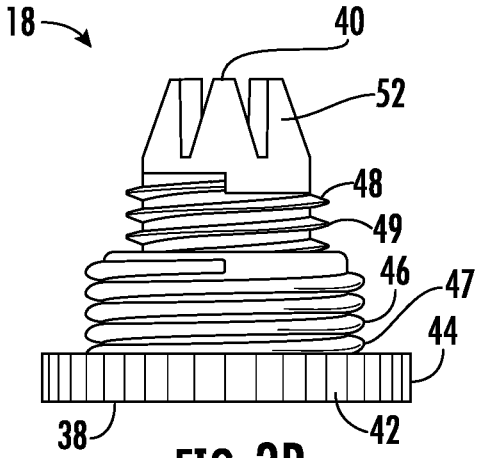
FIG. 3B is a right side elevational view of the threaded adapter portion of FIG. 3A.
Figure 3C:
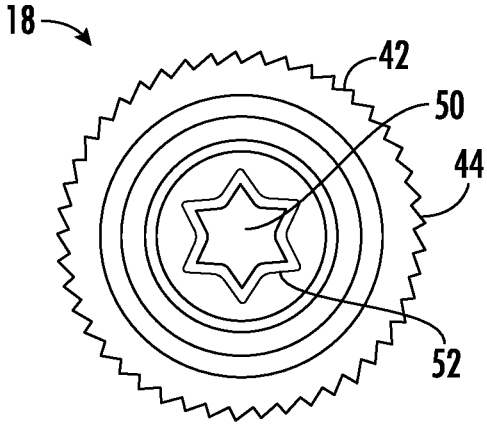
FIG. 3C is a top plan view of the threaded adapter portion of FIGS. 3A and 3B.

Referring now to FIGS. 3A-3C that illustrate an exemplary embodiment of the adapter 18. The adapter 18 has a first end 38, an opposite second end 40, and an opening 50 formed therethrough. The opening 50 may be substantially aligned and/or in communication with the opening 36 of the nozzle 12 to provide a flow path for the material 104 in the internal cavity 102 of the container 100. A radially outwardly extending collar 42 may be formed at the first end 38 of the adapter 18. It is understood that the collar 42 may have any shape, size, and configuration as desired. In some embodiments, the collar 42 includes an annular array of grip elements 44 formed on an outer circumferential surface. As shown, the grip elements 44 may be formed in a saw tooth configuration, although it is understood that other configurations can be used as desired.

In the embodiment shown in FIGS. 3A and 3B, the adapter 18 further includes a threaded portion 46 and a threaded portion 48 formed intermediate the first end 38 and the second end 40. The threaded portion 46 may be formed between the collar 42 and the threaded portion 48. As depicted, each of the threaded portions 46, 48 has a plurality of external threads 47, 49, respectively, formed thereon. An outer diameter of the threaded portion 46 is larger than an outer diameter of the threaded portion 48 and an outer diameter of the collar 42 is larger than the outer diameter of both the threaded portions 46, 48.

As illustrated in FIGS. 6A-6E, the adapter 18 may be configured to releaseably or fixedly engage the nozzle 12. In some embodiments, an inner surface of a portion of the opening 50 adjacent the first end 38 of the adapter 18 may include a plurality of internal threads 51 formed thereon. The internal threads 51 of the adapter 18 may be configured to threadingly engage the external threads 34 of the threaded portion 32 of the nozzle 12.

Referring back to FIGS. 3A-3C, the second end 40 of the adapter 18 and/or the opening 50 may have a specific cross-sectional shape and be configured so that the adapter 18 produces a desired cross-sectional shape of the material 104 dispensed from the container 100. For example, the second end 40 may have one or more inwardly tapered segments 52 that cooperate together to form the opening 50 with a star-shaped cross-section so that the material 104 dispensed therethrough has a generally star-shaped cross-sectional shape. It is understood that the opening 50 and/or the second end 40 of the adapter 18 may have any cross-sectional shape to produce any desired design of the material 104 as desired.

Figure 4A:
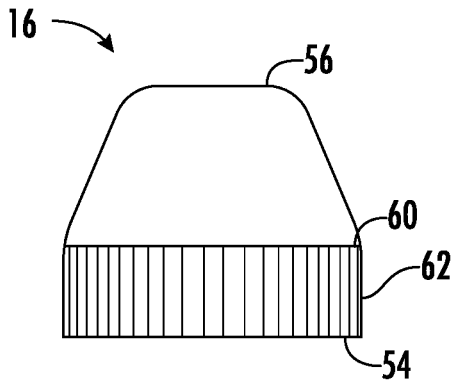
FIG. 4A is a front elevational view of a decorating tip of the nozzle and cap assembly of FIG. 1.
Figure 4B:
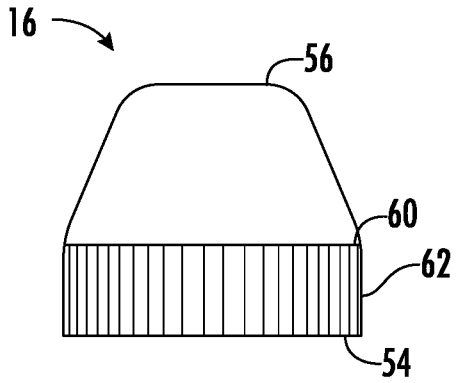
FIG. 4B is a right side elevational view of the decorating tip of FIG. 4A.
Figure 4C:
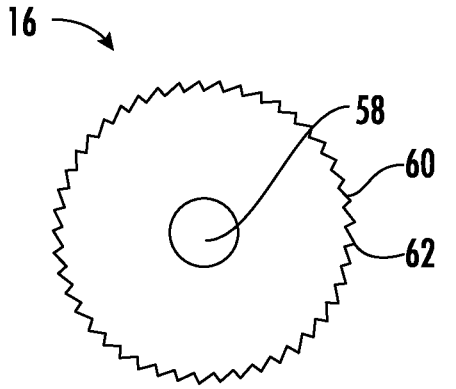
FIG. 4C is a top plan view of the decorating tip of FIGS. 4A and 4B.

Turning now to FIGS. 4A-4C, the tip 16 includes a first end 54, a second end 56, and an opening 58 formed therein. The opening 58 may be substantially aligned and/or in communication with the openings 36, 50 of the nozzle 12 and the adapter 18, respectively, to further provide the flow path for the material 104 in the internal cavity 102 of the container 100. The second end 56 and/or the opening 58 may have a specific cross-sectional shape and be configured so that the tip 16 produces a desired cross-sectional shape of the material 104 dispensed from the container 100. For example, the opening 58 may have a circular cross-sectional shape to produce a continuous extruded ribbon of the material 104 disposed from the container 100 to create writing on the confection. It is understood that the opening 58 and/or the second end 56 of the tip 16 may have any cross-sectional shape to produce any desired design of the material 104 as desired.

A radially outwardly extending collar 60 may be formed at the first end 54 of the tip 16. It is understood that the collar 60 may have any shape, size, and configuration as desired. In some embodiments, the collar 60 includes an annular array of grip elements 62 formed on an outer circumferential surface. As shown, the grip elements 62 may be formed in a saw tooth configuration, although it is understood that other configurations can be used as desired.

As illustrated in FIGS. 6A-6E, the tip 16 may be configured to releaseably or fixedly engage the adapter 18. In some embodiments, an inner surface of a portion of the tip 16 adjacent the first end 54 thereof may include a plurality of internal threads 63 formed thereon. The internal threads 63 of the tip 16 may be configured to threadingly engage the external threads 49 of the threaded portion 48 of the adapter 18.

Figure 5A:
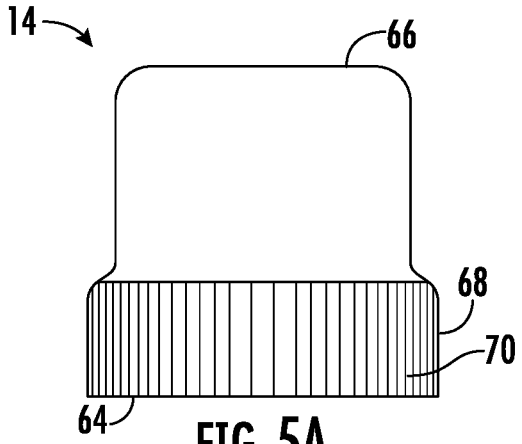
FIG. 5A is a front elevational view of a cap of the nozzle and cap assembly of FIG. 1.
Figure 5B:
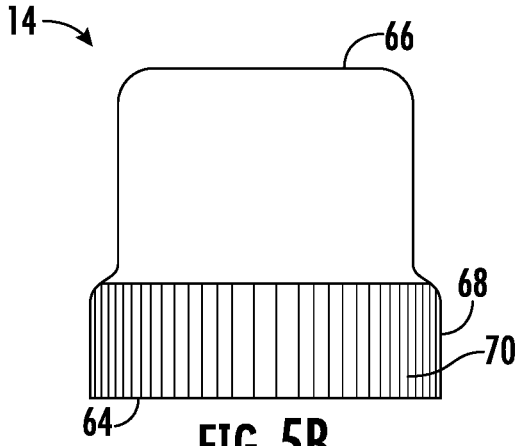
FIG. 5B is a right side elevational view of the cap of FIG. 5A.
Figure 5C:
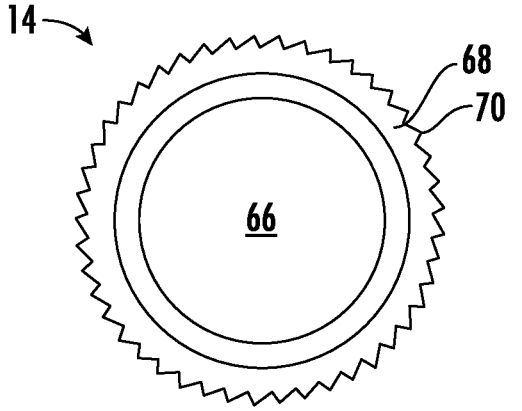
FIG. 5C is a top plan view of the cap of FIGS. 5A and 5B.
Figure 6A:
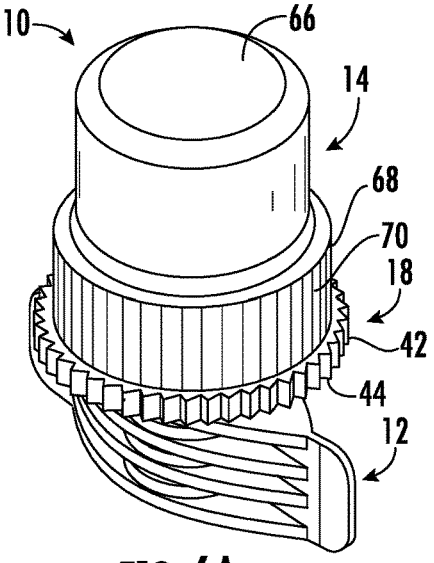
FIG. 6A is top perspective view of the assembled nozzle and cap assembly of FIG. 1.
Figure 6B:
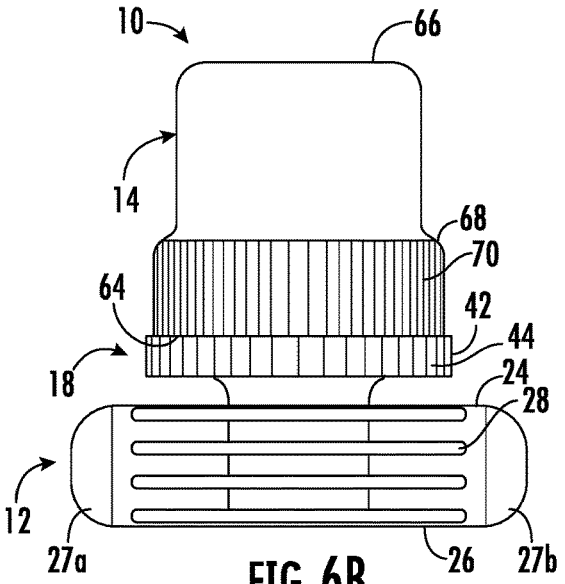
FIG. 6B is a front elevational view of the assembled nozzle and cap assembly of FIGS. 1 and 6A.
Figure 6C:
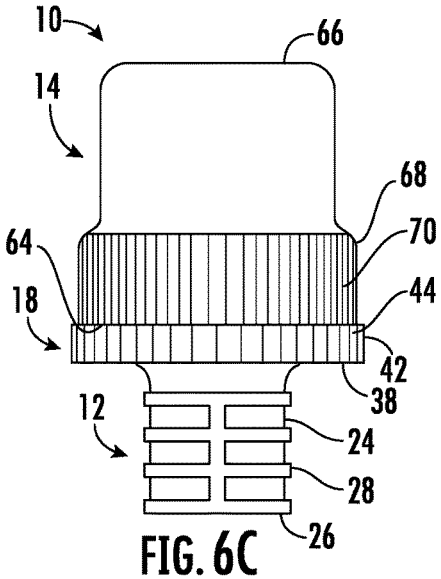
FIG. 6C is a right side elevational view of the assembled nozzle and cap assembly of FIGS. 1, 6A, and 6B.
Figure 6D:
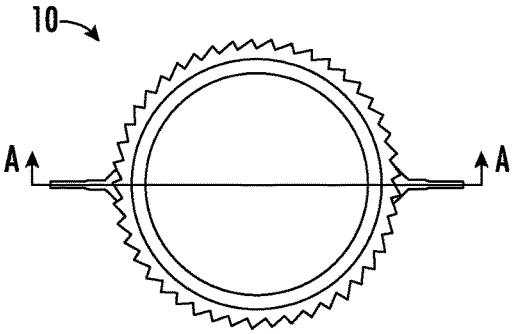
FIG. 6D is a top plan view of the assembled nozzle and cap assembly of FIGS. 1 and 6A-6C.
Figure 6E:
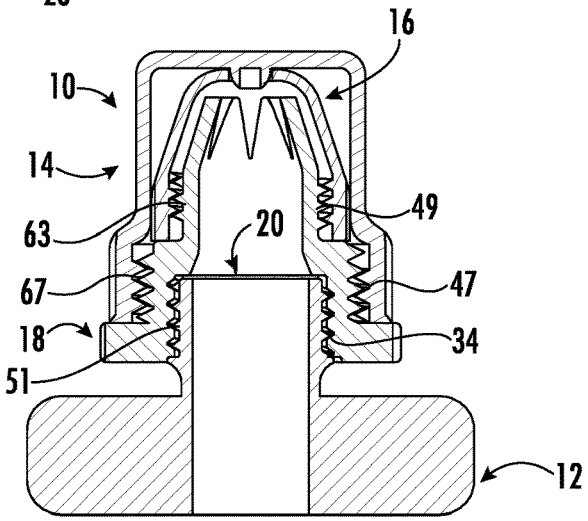
FIG. 6E is a cross-sectional view take along section line A-A of the assembled nozzle and cap assembly of FIGS. 1 and 6A-6D.

Turning now to FIGS. 5A-5C, the cap 14 includes a first end 64 and a second end 66. A radially outwardly extending portion 68 may be formed at the first end 64 of the cap 14. It is understood that the cap 14 may have any shape, size, and configuration as desired. In some embodiments, the portion 68 may include an annular array of grip elements 70 formed on an outer circumferential surface. As shown, the grip elements 70 may be formed in a saw tooth configuration, although it is understood that other configurations can be used as desired.

As illustrated in FIGS. 6A-6E, the cap 14 may be configured to releaseably engage the adapter 18 when the assembly 10 is in a storable state. In some embodiments, an inner surface of a portion of the cap 14 adjacent the first end 64 thereof may include a plurality of internal threads 67 formed thereon. The internal threads 67 of the cap 14 may be configured to threadingly engage the external threads 47 of the threaded portion 46 of the adapter 18.

As assembled, the nozzle and cap assembly 10 is typically provided with the collar 24 of the nozzle 12 suitably joined with the container 100 at an open end thereof, as shown in FIG. 7. The ribs 28 of the collar 24 cooperate with walls of the container 100 to provide a leak proof seal therebetween. The collar 24 can be joined with the container 100 by any conventional joining method such as heat sealing and gluing, for example.

When the nozzle and cap assembly 10 is in an operational state, the sealing element 20 has been removed, the adapter 18 is engaged with the nozzle 12, and the tip 16 is engaged with the adapter 18. On the contrary, when the nozzle and cap assembly 10 is in the storage state, the sealing element 20 may be replaced and the cap 14 may be engaged with the adapter 18.

In use, the cap 14 is removed to facilitate a dispensing of the material 104 from the container 100 through the nozzle 12. Pressure is applied to an outside of the container 100 by a user. The material 104 is then caused to be extruded through the opening 36 of the nozzle 12 and the opening 50 of the adapter 18. In certain instances, the material 104 may only be dispensed through the openings 36, 50 if a star-shaped cross-section of the material 104 is desired for the confectionary. In other instances, the material 104 may be dispensed through the opening 36, 50 and the opening 58 of the tip 16 if it is desired to create an extruded ribbon of material having a specific cross-sectional shape, for example, when writing on a cake. It is understood that various other tips 16 having differently designed openings 58 can be used to create confectionary having other specific designs.

One benefit of this over the known art is the prevention of leaks by installing the sealing element 20 at the second end 30 of the nozzle 12. The nozzle and cap assembly 10 also facilitates an all-in-one versatile assembly which can include the hollow nozzle 12, the cap 14, the hollow tip 16, and the adapter 18 in a single assembly attached to the container 100 containing the material 104. Thus, multiple components, tips, and the like are not required (but can be used), thereby minimizing a complexity and cost of the decorating tool.

From the foregoing description, one ordinarily skilled in the art can easily ascertain the essential characteristics of these embodiments and, without departing from the spirit and scope thereof, can make various changes and modifications to the embodiments to adapt to various usages and conditions.

What is claimed is:

1. An assembly for a dispensing pouch, comprising:

an adapter having a first end, a second end, and an opening formed therethrough extending from the first end to the second end thereof, the adapter configured to releaseably engage a nozzle disposed in the dispensing pouch, wherein the opening of the adapter has a first cross-sectional shape to form a material dispensed from the dispensing pouch into a desired cross-sectional shape determined by the first cross-sectional shape of the opening of adapter, wherein the adapter is configured to releaseably engage a tip having a first end, a second end, and an opening formed therein, and wherein the opening of the tip has a second cross-sectional shape to form the material dispensed from the dispensing pouch.

2. The assembly according to claim 1, wherein the first cross-sectional shape is different from the second cross-sectional shape.

3. A nozzle and cap assembly for a container, comprising:

a hollow nozzle having a first end, a second end, and an opening the first end configured to be disposed in a container;

an adapter having a first end, a second end, and an opening formed in the adapter having a first cross-sectional shape, the first end configured to be releasably engaged with the second end of the hollow nozzle, and the opening configured to be in fluid communication with the opening of the nozzle;

a hollow tip configured to be disposed on and releaseably engaged with the adapter; and a cap configured to be releaseably engaged with the adapter;

wherein the adapter configured to produce a desired cross-section shape of a material when the material is dispensed from the container, and wherein the cap and the hollow tip are configured to be releasably engaged with the adapter at a concurring time.

4. The assembly according to claim 3, wherein the adapter is in threaded engagement with the hollow nozzle.

5. The assembly according to claim 1, wherein the adapter is in threaded engagement with the hollow tip.

6. The assembly according to claim 3, wherein the adapter is in threaded engagement with the cap when the assembly is in a storable state.

7. The assembly according to claim 3, wherein the second end of the hollow nozzle includes a threaded portion.

8. The assembly according to claim 3, wherein the second end of the hollow nozzle extends outwardly from the container.

9. The assembly according to claim 3, further comprising a sealing element configured to militate against a flow of material from the container.

10. The assembly according to claim 9, wherein the sealing element is reusable.

11. The assembly according to claim 9, wherein the sealing element is disposed between the hollow nozzle and the adapter.

12. The assembly according to claim 3, wherein the adapter is entirely external to the container.

13. The assembly according to claim 3, wherein the adapter includes a plurality of threaded portions.

14. The assembly according to claim 13, wherein an outer diameter of one of the threaded portions is larger than an outer diameter of another one of the threaded portions.

15. The assembly according to claim 3, wherein an opening formed in the tip has a second cross-sectional shape.

16. The assembly according to claim 3, wherein the opening formed in the adapter has a star-shaped cross-section.

17. The assembly according to claim 15, wherein the opening formed in the tip has a circular cross-sectional shape.

18. A nozzle and cap assembly for a container comprising:

a hollow nozzle having a first end and a second end, the first end configured to be joined with a container, the second end having a first threaded portion formed thereon;

a threaded adapter configured to be received on the first threaded portion, the threaded adapter having a central aperture formed therein, a second threaded portion, and a third threaded portion;

a hollow tip configured to be received on the third threaded portion; and a cap configured to be received on the second threaded portion.

19. The assembly according to claim 18, further comprising a sealing element configured to militate against a flow of material from the container.

* * * * *